US005388742A

United States Patent [19]

Ethridge et al.

[11] Patent Number: 5,388,742

[45] Date of Patent: Feb. 14, 1995

[54] NAIL COIL RACK

[76] Inventors: Carol M. Ethridge; Kenneth L. Ethridge, both of 6324 E. King St., Tulsa, Okla. 74115

[21] Appl. No.: 158,547

[22] Filed: Nov. 29, 1993

[51] Int. Cl.[6] ..... A45F 5/00

[52] U.S. Cl. ..... 224/255; 224/162; 224/253; 224/904

[58] Field of Search ..... 224/162, 224–226, 224/252, 253, 255, 269, 904

[56] References Cited

U.S. PATENT DOCUMENTS

| | | | |
|---|---|---|---|
| 1,025,520 | 5/1912 | Douglass | 224/225 |
| 2,401,174 | 5/1946 | McAuley | 224/253 X |
| 2,539,242 | 1/1951 | Foss | 224/255 |
| 3,285,482 | 11/1966 | Bedsaul, Sr. | 224/269 X |
| 3,769,733 | 11/1973 | Nelson | 224/253 X |
| 3,796,358 | 3/1974 | Grubb | 224/255 |
| 3,963,156 | 6/1976 | Perrin . | |
| 4,569,466 | 2/1986 | Webber | 224/253 |
| 4,587,818 | 5/1986 | Griffin | 224/252 X |
| 4,739,914 | 4/1988 | Pothetes | 224/253 |
| 4,932,576 | 6/1990 | Ashley | 224/253 |
| 4,986,459 | 1/1991 | Yarbrough, Jr. | 224/253 |

*Primary Examiner*—J. Casimer Jacyna
*Attorney, Agent, or Firm*—Robert K. Rhea

[57] ABSTRACT

A workman's belt supported nail coil rack is formed by an inverted T-shaped member having its bar portion substantially horizontally disposed and its stem elongated for receiving a plurality of nail coils in superposed relation. One end of the T-bar is elongated and turned at right angle to form an upstanding leg which is riveted to a workman's utility belt tool holding pad for supporting the nail rack laterally of a user.

1 Claim, 1 Drawing Sheet

NAIL COIL RACK

BACKGROUND OF THE INVENTION

This invention relates carpentry tools and more particularly to a rack containing a plurality of nail coils supported by a workman's utility belt.

1. Field of the Invention

Power nailers utilize coils of nails which must be kept in their coiled form for ease of loading and feeding into the nailer.

Each coil of nails comprises a plurality of nails of identical size which are disposed in juxtaposed relation and maintained in this position by a succession of juxtaposed nails joined by relatively narrow strips of paper-like material adhering to the respective nail intermediate its ends.

The elongated strip of nails joined by the paper strips are rolled from one end to form a coil of nails. One end of these elongated strips of nails are fed into the power nailer which successively drives one of the nails into structures to be nailed in response to a workman actuating the nail gun.

Since a power nailer rapidly uses all the plurality of nails in a single nail coil, it is desirable that the workman carry a supply on his person, for example, when on a rooftop or the like.

This invention supplies a support rack containing a plurality of superposed nail coils supported by a workman's utility belt.

2. Description of the Prior Art

The prior art is replete with utility belts, supported pouches or racks for holding a plurality of carpenter's tools such as hammers, pliers, screwdrivers, etc.

U.S. Pat. No. 3,963,156 issued Jun. 15, 1976 to Perrin for GUN REST CRADLE and U.S. Pat. No. 4,932,576 issued Jun. 12, 1990 to Ashley for POUCH ASSEMBLY FOR CARPENTERS AND OTHER TRADESMAN are believed good examples of the state-of-the-art.

The Perrin patent, U.S. Pat. No. 3,963,156, discloses strap material bent into U-shaped form and provided on one of its legs with a clip for attachment with a utility belt or a holder thereon for supporting a rifle at the waist of the hunter.

The Ashley patent, U.S. Pat. No. 4,932,576, discloses a utility belt supporting a wire-like tool supporting rack and a pouch which carries a plurality of small tools, nails or screws for the workman.

The rack of this invention is distinctive over these and other similar patents by supporting a dowel-like member in upstanding relation from a horizontally disposed base portion projecting laterally of a workman's utility belt from which it is supported in which the upstanding dowel axially receives a plurality of superposed coils of nails.

SUMMARY OF THE INVENTION

The nail coil rack is inverted T-shaped in general configuration with one end portion of the T-bar turned at right angle in parallel spaced relation with respect to the stem of the T-shape for connection with a slotted belt receiving utility tool support pad.

The upright rod-like stem portion of the T-shape axially receives the core of one or more coils of nails when placed in superposed relation around the stem with the lowermost coil being supported by the platform-like strap member of the T-bar.

The principal object of this invention is to provide a rack for coils of nails which may be carried on the person of a workman for ready access in loading a nail gun.

DESCRIPTION OF THE PREFERRED EMBODIMENTS

Figure 1:
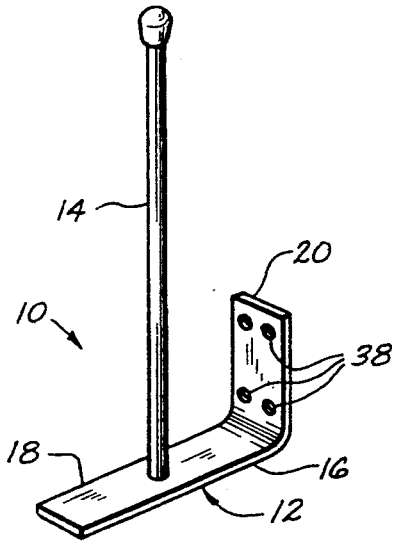
FIG. 1 is a perspective view of the rack, per se.
Figure 2:
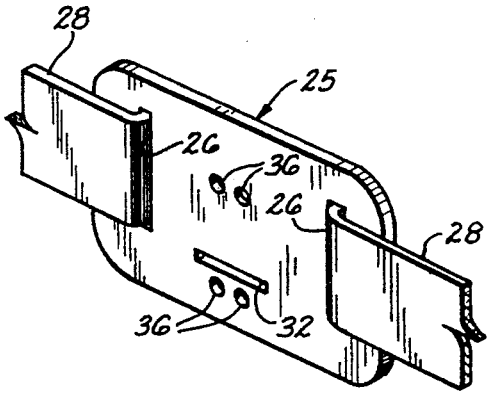
FIG. 2 is a perspective view of a tool support pad supported by a fragment of a user's utility belt.

Like characters of reference designate like parts in those figures of the drawings in which they occur.

In the drawings:

The reference numeral 10 indicates the rack, per se, which is inverted T-shaped in general configuration having a strap-like generally horizontal bar portion 12 and an upstanding rod or dowel-like stem 14.

One end of the bar portion 16 is elongated and turned upward at right angle to form an upstanding leg 20 parallel with the stem 14. The length of the bar portion 16 between the stem 14 and the leg 20 is substantially equal with the length of the bar portion 18 outwardly of the stem 14. The length of the leg 20 is substantially equal with the length of the bar end portion 16 for connection with a utility tool support pad formed of heavy harness leather or other relatively stiff material 25.

The pad 25 is elongated rectangular in general configuration having slots 26 in respective end portions which receive an intermediate portion of a utility belt 28 in a conventional manner. Adjacent, but spaced upwardly from its depending edge and medially its length, the pad 25 is horizontally slotted, as at 32 for inserting the rack leg portion 20 from one surface of the pad to contiguously contact the opposite side of the pad 25.

The leg 20 is secured to the pad 25 by rivets 34 inserted through holes 36 in the pad 25 and cooperating apertures 38 formed in the rack leg 20.

Figure 4:
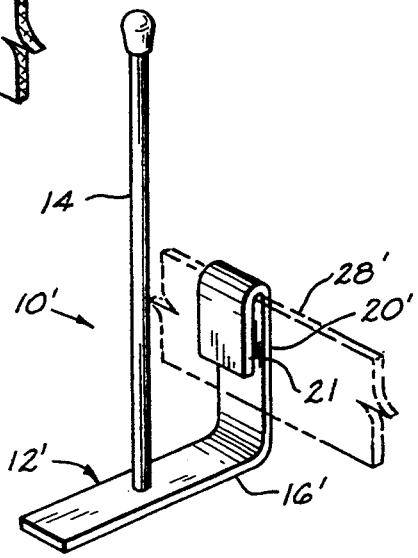

Referring also to FIG. 4, the reference numeral 10' indicates another embodiment of the nail coil rack which is similarly inverted T-shaped in general configuration having a bar portion 12' and a stem 14.

The bar portion 16' is similarly elongated and turned at right angle at one end to form an upstanding leg 20' which is further elongated and doubled back upon itself in U-shaped fashion to form a second or adjacent shorter leg 21 having a length less than the length of the leg 20'.

The inverted U-shape formed by the two legs 20' and 21 received an intermediate portion of a workman's belt 28 indicated by phantom lines.

OPERATION

Figure 3:
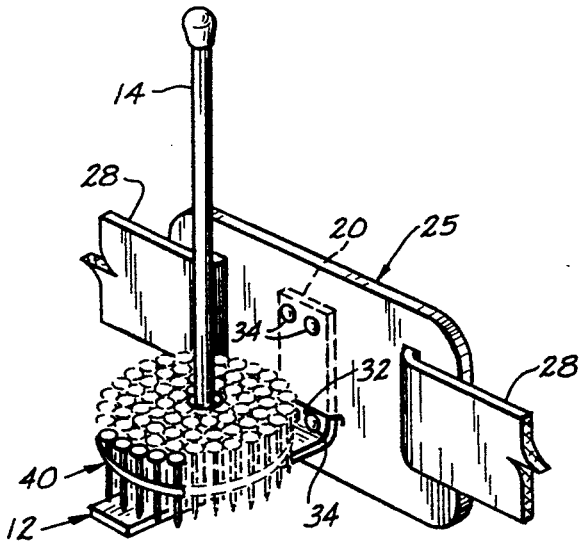
FIG. 3 is a fragmentary view illustrating the rack in operative position with one coil of nails thereon; and, FIG. 4 is a perspective view of another embodiment.

In operation of the rack 10 and pad 25, as illustrated by FIG. 3, the pad is supported on the person of a workman by a belt 28. One or more coils of nails 40 are axially disposed around the stem 14 to be successively removed therefrom as needed for loading a power nailer.

Operation of the embodiment 10' is substantially identical except the legs 20' and 21' are connected with the belt 28'.

Obviously the invention is susceptible to changes or alterations without defeating its practicability. Therefore, I do not wish to be confined to the preferred embodiment shown in the drawings and described herein.

We claim:

1. A nail coil rack for attachment to a belt worn by a user, comprising:

an inverted T-shaped member having an elongated rod-like stem portion and having an elongated strap-like bar portion, bent at right angle at one end portion in upstanding parallel relation with the stem portion and its remaining portion projecting laterally in opposite directions, from the longitudinal axis of the stem portion, at least equidistant with respect to the length of said bar one end portion;

a belt attachable support member of relatively stiff material tending to remain in a planar configuration having opposing end portions and having transverse belt receiving slots therein and having a longitudinally extending aperture substantially medially the slot spacing for receiving said bar one end portion; and, fasteners securing said bar one end portion to said support member opposite the stem portion and on opposite sides of the aperture.

* * * * *